United States Patent [19]

Hutson, Jr. et al.

[11] 4,179,353

[45] Dec. 18, 1979

[54] CONVERSION OF LOW OCTANE NUMBER ALKYLATE TO HIGH OCTANE GASOLINE AND AROMATICS

[75] Inventors: Thomas Hutson, Jr.; Floyd E. Farha, Jr., both of Bartlesville, Okla.

[73] Assignee: Phillips Petroleum Company, Bartlesville, Okla.

[21] Appl. No.: 813,365

[22] Filed: Jul. 6, 1977

[51] Int. Cl.[2] ..... C10G 39/00; C07C 3/52

[52] U.S. Cl. ..... 208/65; 208/49; 208/64; 208/96; 208/135; 585/319; 585/407; 585/415

[58] Field of Search ..... 260/668 R, 668 D, 673.5, 260/683.62; 208/49, 96, 100, 64–65

[56] References Cited

U.S. PATENT DOCUMENTS

| | | | |
|---|---|---|---|
| 2,275,377 | 3/1942 | Frey | 260/683.62 X |
| 2,509,028 | 5/1950 | Abrams et al. | 208/141 X |
| 2,799,627 | 7/1957 | Haensel | 208/96 |
| 2,890,995 | 6/1959 | Findlay | 208/65 |
| 2,983,773 | 5/1961 | Ballard et al. | 260/683.62 |
| 3,502,569 | 3/1970 | Hervert | 208/49 |
| 3,844,935 | 10/1974 | Drehman et al. | 208/79 |
| 3,883,418 | 5/1975 | Drehman et al. | 208/66 |
| 4,105,707 | 8/1978 | Little et al. | 260/683.48 |

*Primary Examiner*—Delbert E. Gantz
*Assistant Examiner*—G. E. Schmitkons

[57] ABSTRACT

An intentionally produced low octane value alkylate is reformed in the presence of steam, and in the absence of added hydrogen, to produce a high octane value, olefinic reformate containing aromatics. The reformate, upon fractionation to remove hydrogen and methane and $C_3$ and $C_4$ hydrocarbons, which can be recycled, is subjected to solvent extraction to produce a raffinate which can be used as high octane gasoline and which contains olefins, and an extract which, upon fractionation to remove xylenes therefrom as usable product, and which now contains benzene and toluene, can be combined with said raffinate.

7 Claims, 1 Drawing Figure

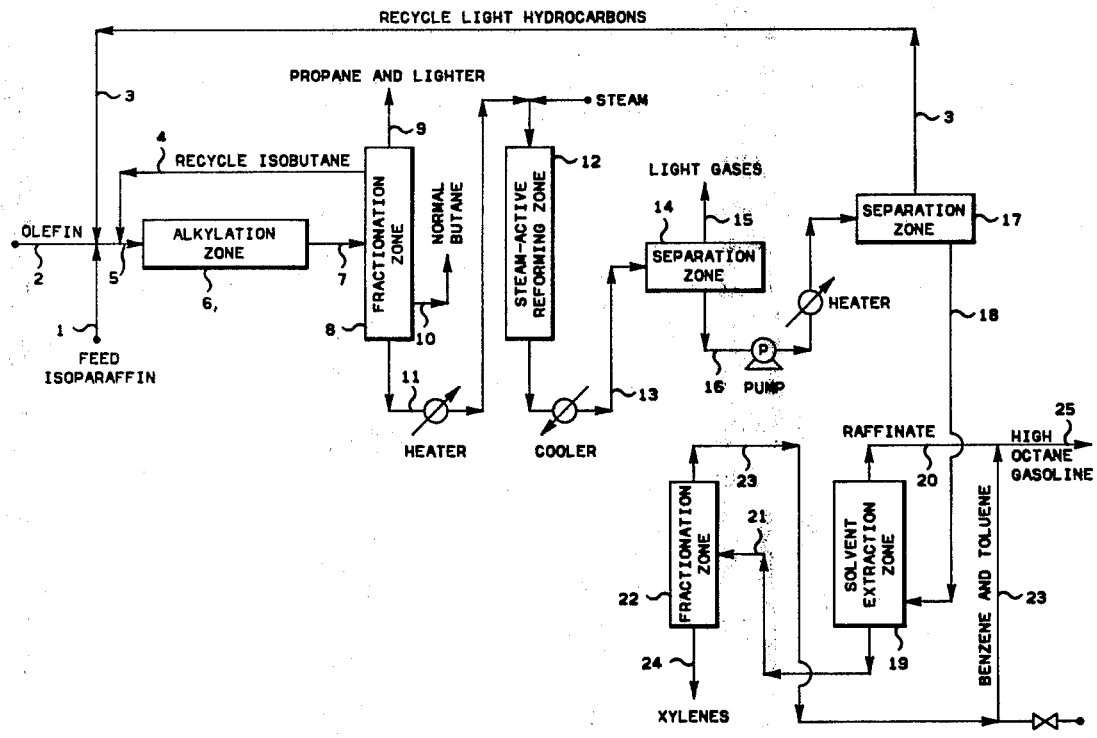

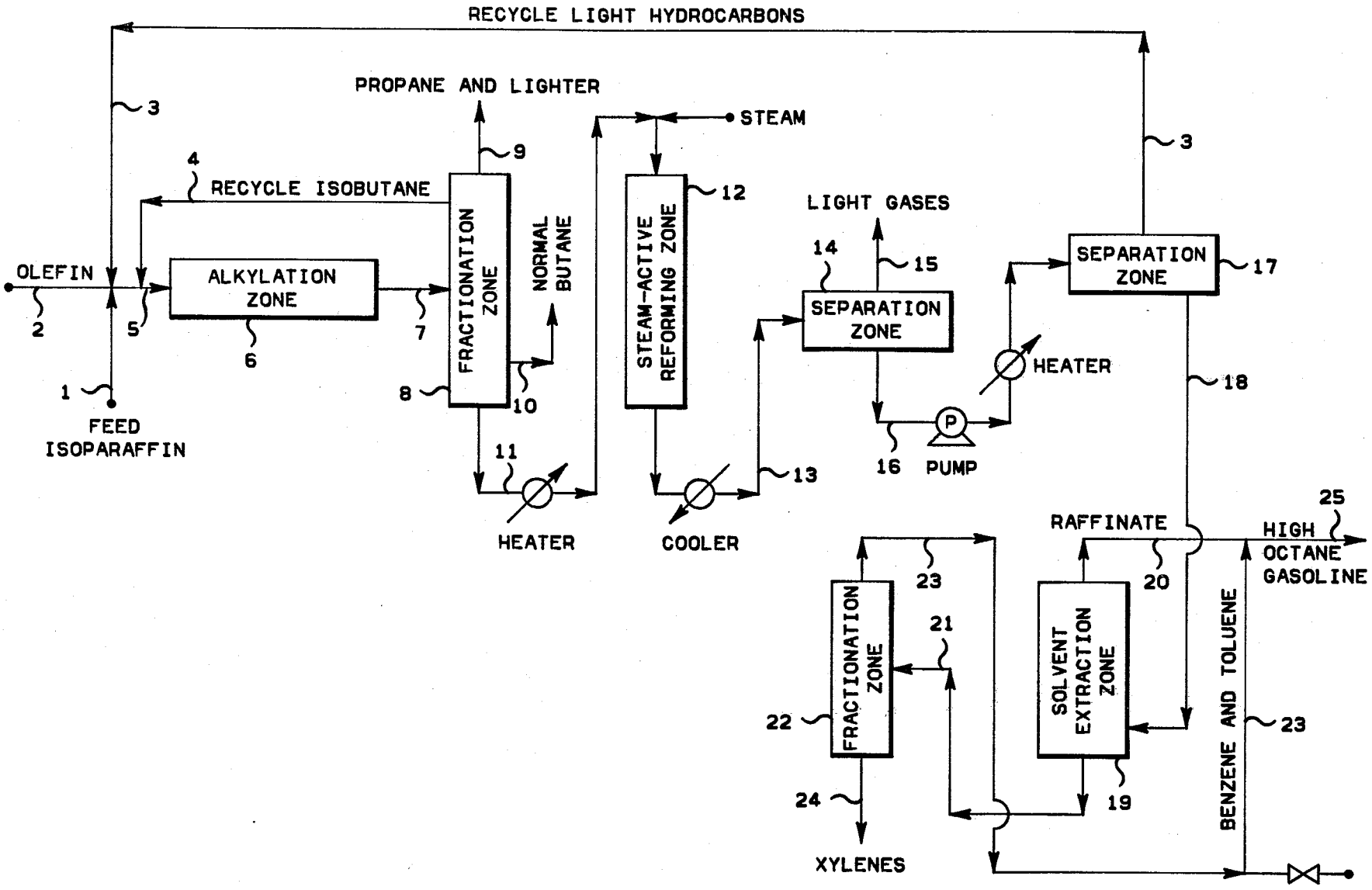
RECYCLE LIGHT HYDROCARBONS
3
OLEFIN
2
FEED ISOPARAFFIN
1
5
RECYCLE ISOBUTANE
4
ALKYLATION ZONE
6
7
FRACTIONATION ZONE
8
PROPANE AND LIGHTER
9
NORMAL BUTANE
10
11
HEATER
STEAM
STEAM-ACTIVE REFORMING ZONE
12
COOLER
13
SEPARATION ZONE
14
LIGHT GASES
15
16
PUMP
P
HEATER
SEPARATION ZONE
17
18
RAFFINATE
20
SOLVENT EXTRACTION ZONE
19
BENZENE AND TOLUENE
23
HIGH OCTANE GASOLINE
25
FRACTIONATION ZONE
22
21
XYLENES
24

CONVERSION OF LOW OCTANE NUMBER ALKYLATE TO HIGH OCTANE GASOLINE AND AROMATICS

This invention relates to alkylation. In one of its aspects, it relates to alkylation of an isoparaffin with an olefin in the presence of a catalyst.

In one of its concepts, the invention provides a process for producing intentionally a low octane value alkylate containing reaction product, the product is fractionated to obtain a stream containing $C_5$ and heavier hydrocarbons, the stream thus obtained is subjected to reforming in the presence of steam, in the absence of added hydrogen, and in the presence of a catalyst selected from the group consisting of Group VIII metal in combination with a tin-modified Group II metal aluminate to produce a reaction stream containing the constituents of a high octane, olefin-containing gasoline.

In another of its concepts, the invention provides production of such a low octane value alkylate having a Research Octane Number, clear, of below about 90, with said alkylate being produced at a relatively low isoparaffin to olefin ratio, of the order of about 2.5 to 9.

In a further concept of the invention, the olefin used in the alkylation will contain a substantial proportion of butene-1.

In another of its concepts, the combination of steps of the invention, i.e., the production of an alkylation reaction product containing components having a low octane value which are then reformed in the presence of steam, and in the absence of added hydrogen, and in presence of a catalyst, will be effected under conditions and with a catalyst as described in U.S. Pat. No. 3,844,935, issued Oct. 29, 1974, Lewis E. Drehman and Floyd E. Farha, Jr.

A still further concept of the invention provides for fractionation of the steam reformate stream to obtain therefrom $C_5$ and heavier fraction, subjecting said fraction to solvent extraction, producing a raffinate of high octane value, olefinic gasoline and an extract which can be fractionated to remove xylenes therefrom, obtaining an overhead containing benzene and toluene which can be combined with the olefinic gasoline or raffinate.

In a further concept of the invention, there is provided a process, as described, permitting in the alkylation step the use of olefins such as butene-1 which produce low octane dimethylhexanes at relatively low isobutane-to-olefin mol ratios which, however, allow minimizing the size of the relatively expensive isoparaffin recovery facilities.

The alkylation of hydrocarbons, generally, is an old and well-known art. Many concepts have been set forth to maximize product quality and yield while at the same time minimizing costs of operation. Costs of operation necessarily involve energy considerations, not only in the operation of a plant producing the product, but also in the producing of the equipment needed. Emphasis, today, is on saving or conservation of energy. Accordingly, concepts of operation which will produce high quality and high yields of alkylate gasolines at lower costs of energy are desirable.

It is an object of this invention to produce an alkylate. It is another object of this invention to provide a process for the alkylation of an isoparaffin with an olefin. It is a still further object of the invention to provide an alkylation operation in which a relatively low octane value product containing alkylation reaction mass can be obtained, all the while providing for the upgrading to a final product having high octane value. A still further object of the invention is to provide a combination of steps employing an alkylation and a reforming in which no added hydrogen is needed. A still further object of the invention is to provide in such a combination a catalyst suited to upgrade the initial alkylation reaction mass components which ultimately can form a high octane value gasoline.

Other objects, concepts, and aspects, as well as the several advantages of the invention, are apparent from a study of this disclosure, the drawing, and the appended claims.

According to the present invention, there is produced an alkylate reaction mass or product by the alkylation in the presence of an alkylation catalyst of an isoparaffin with an olefin using conditions and/or starting materials which permit cost savings, e.g., a low isobutane-to-olefin mol ratio and/or as at least a portion of the olefin butene-1, which results, intentionally, in an alkylate reaction mass containing gasoline boiling range components which have a low octane value and then subjecting said components to a reforming in the presence of steam, in the absence of any necessarily added hydrogen, under conditions to produce high octane value components in the reformate.

Also, according to the present invention, there is provided a process for alkylation as described in combination with a solvent extraction and a fractionation operated in combination to obtain a raffinate having olefinic, high octane value gasoline components and wherein upon separation of xylenes from the extract at least a portion of the extract containing benzene and toluene is combined with said raffinate.

Further according to the present invention, the combination of the alkylation, reforming, and subsequent solvent extraction to produce the high octane value gasoline is made possible with the use of a catalyst, as described in U.S. Pat. No. 3,844,935, above-mentioned.

One skilled in the art in possession of this disclosure will study the same in the light of knowledge of the art, as evidenced in the following patents, the disclosures of which are incorporated herein by reference, to provide background and to permit avoiding unduly burdening this disclosure.

Thus, there is incorporated by reference the information from the disclosures of the following U.S. Pat. Nos: 2,799,627, July 16, 1957; 2,890,995, June 16, 1959; 2,932,612, Apr. 12, 1960; 2,976,231, Mar. 21, 1961; 3,030,299, Apr. 17, 1962; 3,045,055, July 17, 1962; 3,461,177, Aug. 12, 1969; 3,502,569, Mar. 24, 1970; 3,844,935, Oct. 29, 1974; and 3,883,418, May 13, 1975.

To aid one skilled in the art in his study of the disclosures of the foregoing patents and to relate their information to the operation of this invention, reference is now made to the description of a flow scheme of an embodiment according to the invention and to a tabulation of the preferred conditions or parameters suited to the invention. It will be noted that the approximate ranges, as well as a specific, selected value for the parameter or condition, are given in the table.

Referring now to the drawing, isoparaffin and olefin are introduced by 1 and 2, together with $C_3$, $C_4$ olefin and normal and isoparaffin being recycled by 3 and with isoparaffin being recycled by 4 by way of 5 in HF alkylation zone 6. Generally, the conditions for the alkylation to be effected here can be selected by one skilled in the art in possession of this disclosure having studied the same and appear largely given in the tabulation following.

Alkylation reaction hydrocarbon mass 7, upon separation of the HF acid, by known means, is fractionated in zone 8 to remove propane and any lighter gases at 9, normal butane at 10 and a $C_5$ and heavier fraction which is passed by 11 to reforming zone 12. In reforming zone 12 there is employed a catalyst which will upgrade the hydrocarbons therein, producing olefinic, as well as aromatic, components suitable for use in high octane gasoline.

The bottoms from separator 17 constitute a $C_5$ and heavier fraction 18 passed to solvent extraction zone 19 wherein, under conventionally available conditions, a raffinate 20 which is olefinic in character and suitable for high octane gasoline is recovered.

An extract 21 is passed to fractionation zone 22, bottoms from which 24 contain xylenes which are recovered as a product of the process.

Finally, the overhead 23 from fractionation zone 22, which contains benzene and toluene, is blended with raffinate in 20 to produce a final product 25 of the process.

| Operating Conditions: | Ranges | Specific |
|---|---|---|
| HF Alkylation (6): | | |
| Temperature, °F. | 40 to 120 | 80 |
| Pressure | To maintain liquid phases | |
| HF/Total H/C Vol. Ratio | 0.5 to 20 | 7 |
| Total $iC_4$/Olefin Mol Ratio | 2.5 to 9 | 7.5 |
| Residence time, minutes | 0.5 to 30 | 1 |
| HF Strength, vol. percent | 85 to 95 | 90 |
| Fractionation (8): | | |
| Pressure, psig | 275 to 350 | 300 |
| Top Temperature, °F. | 135 to 145 | 140 |
| Bottom Temperature, °F. | 400 to 435 | 420 |
| Reforming Zone (12): | | |
| Pressure, psig | 40 to 400 | 80 |
| Temperature, °F. | 1000 to 1150 | 1050 |
| Hydrocarbon Space Velocity, WHSV[a] | 1.75 to 4 | 2.8 |
| Steam/Hydrocarbon Mol Ratio | 0.5 to 30 | 5 |
| The specific catalyst used in reformer 12 contains one weight percent Sn and 0.6 weight percent Pt on a suitable nonacidic (zinc aluminate) support. | | |
| Separator (14): | | |
| Pressure, atmospheres | 0.5 to 10 | atmospheric |
| Temperature, °F. | 65 to 115 | 85 |
| Separator (17): | | |
| Pressure, psig | 80 to 120 | 100 |
| Temperature, °F. | 117 to 135 | 132 |
| Solvent Extraction (19)[b]: | | |
| Pressure, psig | 5 to 15 | 10 |
| Temperature, °F. | 175 to 225 | 200 |
| Solvent/Feed Vol. Ratio | 2.5 to 4.0 | 3 |
| The specific solvent used is sulfolane; other solvents include diethylene glycol, triethylene glycol, N-methylpyrrolidone, and furfural. | | |
| Fractionation (22): | | |
| Pressure, psig | 5 to 15 | 10 |
| Top Temperarure, °F. | 225 to 252 | 240 |
| Bottom Temperature, °F. | 320 to 356 | 340 |

[a]This weight hourly space velocity (WHSV) is equal to a gas hourly space velocity (GHSV) in the range of 160 to 400, and specifically 270 actual cubic feet of hydrocarbon vapor (does not include steam) at reactor conditions per cubic foot of catalyst per hour.
[b]This zone includes conventional solvent removal from products. The conditions given are for the solvent extraction step only.

Presently, there is known to us a catalyst particularly suited to the execution of the invention. It is described in U.S. Pat. No. 3,844,935, above mentioned. Generally, the conditions of operation given in this patent can be applied in reforming zone 12.

The catalyst of U.S. Pat. No. 3,844,935 being particularly suited to the invention is, of course, now preferred. Other catalysts to effect the reforming and conditions suited to those catalysts to effect the reforming of the invention which may exist can be used in the combination of the invention.

Stream 13 containing the reformed hydrocarbons is passed to separator 14 wherefrom hydrogen and methane are removed at 15. The remainder of the stream passes by 16 to separator 17 from which there is removed by 3 the recycled hydrocarbons, earlier mentioned.

| | Process Flow: | Specific |
|---|---|---|
| (2) | Olefin Feed, B/D | 1250 |
| | Contains, Vol. %: | |
| | Propylene, 43.5 | |
| | Butylenes, 56.3 | |
| | Amylenes, 0.2 | |
| (1) | Fresh Isobutane, B/D | 1562.5 |
| (4) | Recycle Isobutane, B/D | 9375 |
| (3) | Recycle Material, B/D | 356.3 |
| | Contains 46.5 volume % olefins in the $C_3 = - C_4 =$ range. | |
| (7) | Alkylate ($C_5$+): | |
| | Barrels/Day | 2375 |
| | RON (clear) | 88–89 |
| (25) | Total Product Gasoline: | |
| | Barrels/Day | 1868.8 |
| | RON (clear) | 95 |
| (24) | Xylenes Product: | |

-continued

| Process Flow: | Specific |
|---|---|
| Barrels/Day | 237.5 |

The isoparaffin fed to the alkylation zone 6 can be isobutane, isopentane, and/or isohexane, especially isobutane. The olefins can be propylene, butylenes, especially butene-1 which produces inferior octane HF alkylate, and/or amylenes.

In reforming zone 12 the isoparaffinic, low octane value alkylate-containing stream is converted mainly into monoolefinic and aromatic hydrocarbons.

The isoparaffins, e.g., isobutane, isopentane, and/or isohexanes, which are alkylated with olefins, e.g., propylene, butylenes (butene-1, cis- and trans-butene-2, isobutylene), and/or amylenes, in the presence of HF catalyst can also be alkylated in the presence of other catalysts known in the art which include sulfuric acid, aluminum chloride either as the hydrocarbon complex or supported on a solid, boron trifluoride as a liquid or supported on a solid, and the like.

In addition to the solvents given for the solvent extraction, other solvents for the extraction and conditions as are known in the art can be employed.

If desired, a conventional mild hydrogenation (not shown) of the stream 13, to convert diolefins to monoolefins, can be effected in order to remove this small quantity of diolefinic material from this product.

Reasonable variation and modification are possible within the scope of the foregoing disclosure, and drawing, and the appended claims to the invention the essence of which is that there is intentionally produced a low octane value component-containing alkylation reaction mass under conditions presenting considerations of economy of energy whereupon said components are reformed for ultimate recovery therefrom by a combination of steps including solvent extraction of a high octane value gasoline component-containing stream; in one embodiment of the invention, there being employed a low isoparaffin-to-olefin ratio, substantial butene-1 in the alkylation step, and a catalyst as described in the reforming step.

We claim:

1. An alkylation process comprising alkylating an isoparaffin intentionally with olefins which yield a low octane value alkylate, in the presence of an alkylation catalyst intentionally under conditions including the deliberate selection and use of low-octane producing olefins including a substantial proportion of propylene and butene-1 which produce low-octane alkylate, said olefins having been formed in an ensuing reforming operation, and intentionally at a low isoparaffin to olefin ratio which will produce a low octane value alkylate product, thus to produce an alkylate product constituted by $C_5$ hydrocarbons and heavier and composed of components of relatively low octane value of the order of about below 90, Research Octane Number clear, and then reforming said alkylate product as obtained upon separation only of n-butane and lighter hydrocarbons therefrom in a reforming zone in the presence of a catalyst under conditions including a temperature in the approximate range of from about 1000° to about 1150° F. to produce reformed alkylate product having Research Octane Number clear of at least about 95, said reforming zone being the situs of said reforming operation.

2. A process according to claim 1 wherein the reforming is accomplished in the presence of a catalyst selected from the group consisting of Group VIII metal in combination with a tin-modified Group II metal aluminate and wherein said Group VIII metal is selected from the group consisting of nickel, platinum, ruthenium, palladium, iridium, osmium, and mixtures thereof.

3. A process according to claim 2 wherein said Group VIII metal is platinum and said Group II metal aluminate is zinc aluminate.

4. An alkylation according to claim 1 wherein the alkylate is reformed in the presence of a catalyst and steam but in the absence of added hydrogen.

5. An alkylation according to claim 1 wherein the reformed alkylate product is fractionated to remove $C_5$ and heavier, the $C_5$ and heavier fraction is solvent-extracted to obtain a raffinate which is olefinic in character and possesses a high octane value.

6. A process according to claim 5 wherein the extract from the solvent extraction zone is fractionated to remove therefrom xylenes as a product and the remainder, containing benzene and toluene, is combined with said raffinate to form a final high octane value product.

7. A process according to claim 1 wherein the alkylation is accomplished using a substantial proportion of butene-1.

* * * * *